United States Patent [19]

Stevens

[11] 4,048,873

[45] Sept. 20, 1977

[54] DOOR SECURITY LOCK OPENING TOOL AND METHOD OF USING SAME

[75] Inventor: Henry H. Stevens, Ottumwa, Iowa

[73] Assignees: Tony Johnson; Eloise Johnson; Dale Stevens, all of Ottumwa, Iowa; Doyle Stevens; Tom Stevens, both of Longmont, Colo.; Fern Casady, Centerville, Iowa

[21] Appl. No.: 713,256

[22] Filed: Aug. 10, 1976

[51] Int. Cl.[2] ..... B25B 27/00

[52] U.S. Cl. ..... 81/3 R

[58] Field of Search ..... 29/426, 427, 270, 278; 81/3 R

[56] References Cited

U.S. PATENT DOCUMENTS

| | | | |
|---|---|---|---|
| 2,344,696 | 3/1944 | Graham | 81/3 R |
| 2,885,917 | 5/1959 | Smith | 81/3 R |
| 2,907,237 | 10/1959 | Casas | 81/3 R |
| 2,948,058 | 8/1960 | Culkosky | 81/3 R X |

*Primary Examiner*—Milton S. Mehr

*Attorney, Agent, or Firm*—Zarley, McKee, Thomte, Voorhees & Sease

[57] ABSTRACT

A U-shaped member includes an actuating leg and a handle leg interconnected by a base portion wherein the legs are substantially equal in length with the actuating leg being telescopic if desired. The actuating leg is placed on the inside of the door with the handle leg on the outside. The free end of the actuating leg is positioned against the slider element connected to the security chain and the handle is moved along a line parallel to the slot and passageway in the lock on the door thereby moving the slider to an access opening for removal therefrom, thereby allowing the door to be opened. An alternate embodiment includes leg portions extending perpendicular to the actuating and handle legs to increase the effective length of the tool when being used on locks positioned at an angle to the horizontal. The free end of the actuating leg may have an enlarged end portion which may have a Y-shape including a slot for engagement with the slider.

6 Claims, 8 Drawing Figures

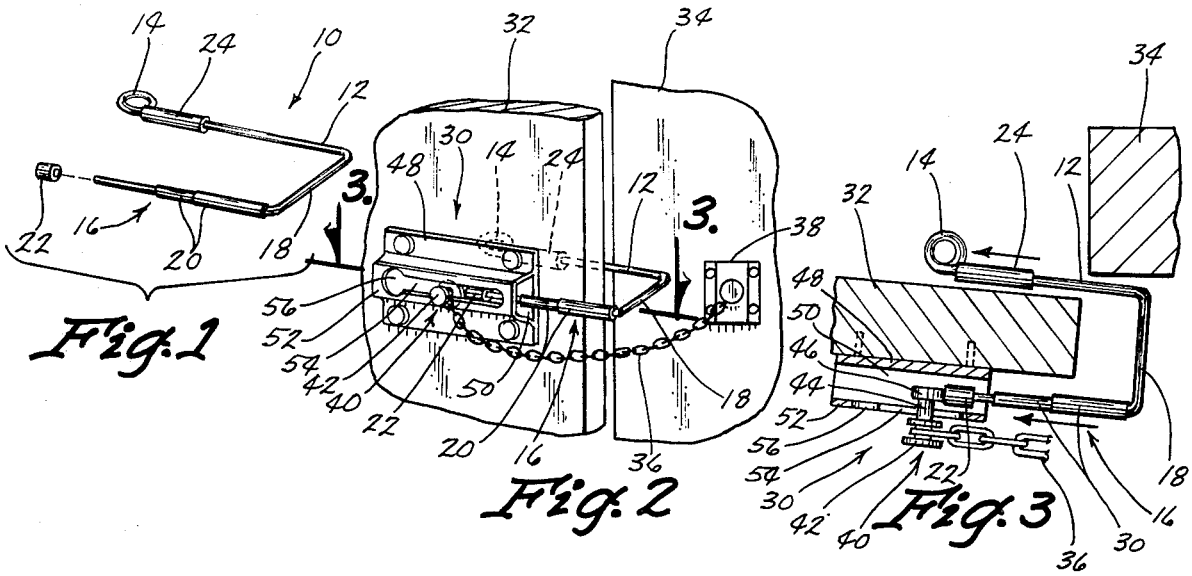
Fig. 1
Fig. 2
Fig. 3
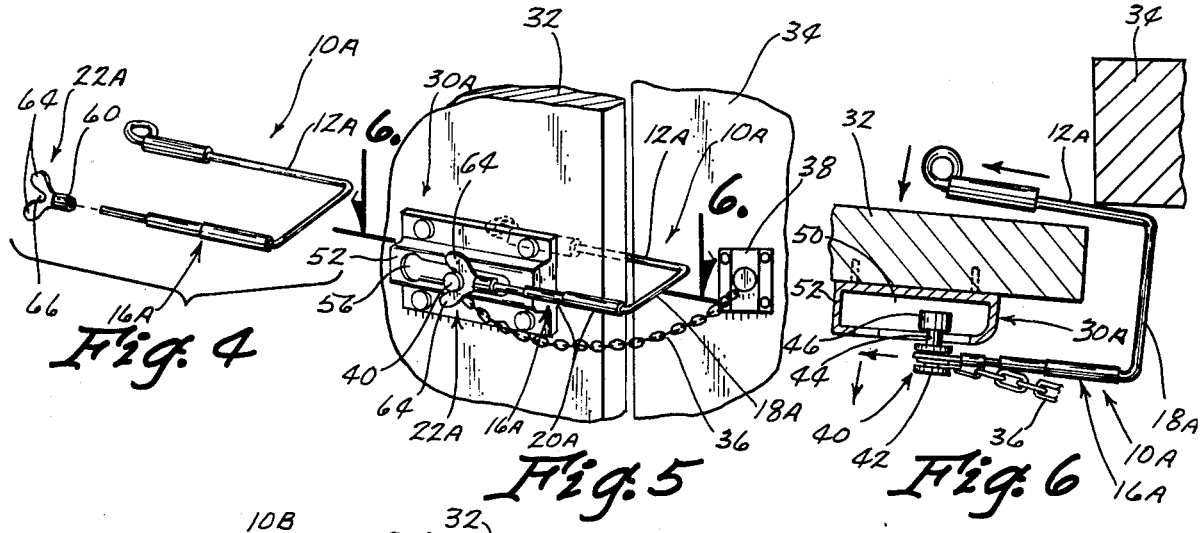
Fig. 4
Fig. 5
Fig. 6
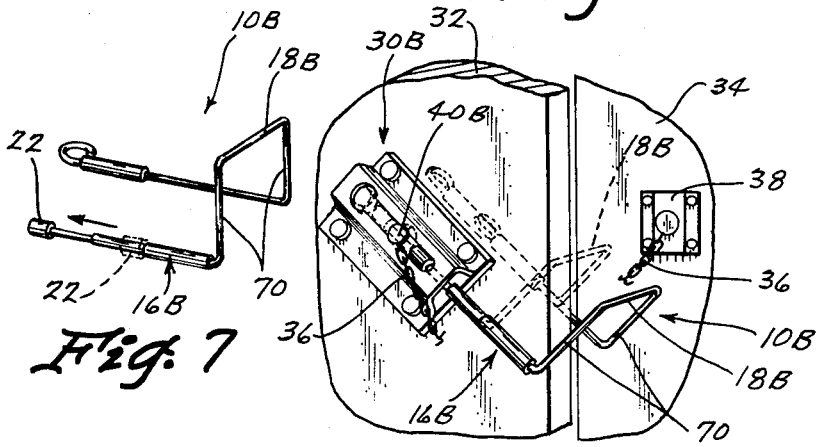
Fig. 7
Fig. 8

DOOR SECURITY LOCK OPENING TOOL AND METHOD OF USING SAME

BACKGROUND OF THE INVENTION

There are times when there are legitimate reasons for opening a security lock from the outside. For example, it sometimes is necessary to gain entrance into motel rooms in cases where the occupant is unable to open the security lock on the door. Heretofore, it would be necessary to either cut the chain or break open the door. Both of these methods cause damage and incur substantial cost for the motel to return the door and lock to their normal condition. Accordingly, a tool is needed that will allow the security lock to be opened from the outside without damaging the door or the lock.

SUMMARY OF THE INVENTION

The door security lock opening tool of this invention is U-shaped and includes an actuating leg which is adapted to be positioned on the inside of the door and a handle leg which is positioned on the outside of the door. The free end of the actuating leg is positioned against the slider connected to the chain which extends across the door opening to the door frame where it is anchored. By moving the handle leg along a line parallel to the slot in the door lock bracket and the passageway between the door and the bracket, the slider will be moved to the slider access opening at the inner end of the slot and passageway thereby allowing the slider to be removed from the bracket and the door to be opened.

A more versatile tool is possible by making the actuating leg telescopically extendable and thus the desired leg length can be provided which will be appropriate for the particular position of the slider on the door being opened. When the lock bracket is positioned at an angle to the horizontal and the slider needs to be moved upwardly and inwardly, the tool may include a perpendicular portion between the base portion and the two legs, thereby increasing the effective length of the tool when embracing a door during the opening operation. The free end of the actuating leg may have an enlarged cap portion or may be Y-shaped to provide a notch for engaging the slider.

DESCRIPTION OF THE DRAWINGS

FIG. 1 is a perspective view of the door security lock opening tool of this invention.

FIG. 2 is a fragmentary perspective view showing the tool in use on a locked door.

FIG. 3 is a cross-sectional view taken along line 3—3 of FIG. 2.

FIG. 4 is a view similar to FIG. 1, but showing an alternate actuating head on the actuating leg of the tool.

FIG. 5 is a fragmentary perspective view of the tool of FIG. 4 in use on a door.

FIG. 6 is a cross-sectional view taken along line 6—6 of FIG. 5.

FIG. 7 is a perspective view of a further alternate embodiment of this invention.

FIG. 8 is a fragmentary perspective view of the tool of FIG. 7 in use.

DESCRIPTION OF THE PREFERRED EMBODIMENT

The door security lock opening tool of this invention is referred to generally in FIG. 1 by the reference to numeral 10. The tool is seen to be U-shaped and includes a handle leg portion 12 with a finger engaging loop portion 14 at the free end thereof. An actuating leg 16 is provided parallel to the handle leg 12 and is connected thereto by a base portion 18. The actuating leg 16 includes telescoping sections 20 to give it the desired length. The free end of the leg 16 includes an enlarged actuating head 22 telescopically positioned on the outer telescopic section. A plastic sleeve 24 may be provided on the tool and in particular on the handle leg to provide greater ease in gripping the tool. The tool may be preferably made from rod and tube like material.

In FIGS. 2 and 3 the conventional security lock 30 is shown in use on a door 32 slightly opened from the door frame 34. A chain 36 is anchored to a bracket 38 on the door frame and extends to a slider 40 having an outer head 42 connected to a pin 44 and in turn connected to an inner head 46. A lock plate bracket 48 is positioned on the inner side of the door 32 and includes a passageway 50 between the door and the plate portion 52 having a slot 54 connected to an access enlarged opening 56 at the inner end thereof. Thus, the slider inner head 46 will pass through the access opening 56 but not through the slot 54, and accordingly, when the slider 40 is moved to the access opening, it can be positioned in the slot or removed therefrom.

Thus, in operation, the tool is positioned between the door 32 and the door frame 34 and then the actuating leg is lined up with the longitudinal axis of the passageway 50, such that it is parallel thereto.

As seen in FIGS. 2 and 3, the actuating head 22 is positioned in the passageway 50 against the inner end of the slider 40 and specifically against the inner slider head 46. Movement of the handle leg 12 in the direction indicated by the arrow in FIG. 3 parallel to the longitudinal axis of the passageway 50 and the slot 54, causes the slider to be moved toward the access opening 56 whereupon the slider may be removed from the slot and the door may be opened as the chain 36 will drop freely away from the door. The tool may then be removed and the door opened.

In FIGS. 4–6, a modified tool 10A is shown similar to the tool 10 but including a different head 22A. The head 22A is Y-shaped, having a stem portion 60 which is fitted over the free end of the actuating leg 16A and outwardly flaring legs 64 are connected to the stem portion 60 and define a slot 66 for engagement with the slide pin 44 as seen in FIG. 6. In this embodiment the actuating leg is placed not in the passageway 50 but on the outside of the plate 52 and thus the guide capability of the Y-shaped actuating head 22A is desirable. The passageway 50 functions as a guideway for the actuating leg 16 in the embodiment of FIGS. 1–3. The structure and operation of the embodiment in FIGS. 4–6 is otherwise identical to that of the embodiment of FIGS. 1–3.

A further embodiment is illustrated in FIGS. 7 and 8 and is referred to generally by the reference numeral 10B. This embodiment is shown with the enlarged actuating head 22 but could include the Y-shaped actuating head 22A. The difference between the two previous embodiments is that the leg portions 16B and 12B are connected to perpendicular leg portion 70, in turn connected to the base portion 18B, thereby offsetting the base portion from the plane of the leg 16B and 12B. The advantage for this structural change is seen in FIG. 8 wherein the lock 30B is positioned at an angle to the horizontal on the inside of the door 32 thereby requiring that the slider 40B be pushed upwardly and inwardly and that the tool have an effective longer length in order to not be limited by the outer edge of the door, as would be the case if the base portion 18B was not offset by the perpendicular portions 70.

It is seen that the handle leg and actuating leg are substantially equal in length, although if necessary when the actuating leg is telescopically extended, the operator may reach through the space between the door and the door frame to operate the handle leg should the actuating leg be significantly longer. The actuating leg needs to be as long as the distance between the access opening and the door edge measured along a line parallel to the longitudinal axis of the slot and passageway.

What is claimed is:

1. A tool for unlatching door security locks of the type having a chain extending from the door frame to a slider movable in an access opening at the inner end of a slot in a plate secured to the door and forming a passageway between the plate and door open at the end adjacent the door edge, said tool comprising, a U-shaped elongated member having an actuating leg and a handle leg interconnected by a base portion wherein the outer end of said actuating leg positioned on the inside of the door is adapted to engage said slider in said passageway or on the outside of the said plate for moving the slider in said slot towards said access opening for removal therefrom as a person moves the handle leg along a line parallel to the longitudinal axis of said slot and passageway, and said actuating leg including telescopically extendable sections for varying the length thereof.

2. A tool for unlatching door security locks of the type having a chain extending from the door frame to a slider movable in an access opening at the inner end of a slot in a plate secured to the door and forming a passageway between the plate and door open at the end adjacent the door edge, said tool comprising, a U-shaped elongated member having an actuating leg and a handle leg interconnected by a base portion wherein the outer end of said actuating leg positioned on the inside of the door is adapted to engage said slider in said passageway or on the outside of said plate for moving the slider in said slots towards said access opening for removal therefrom as a person moves the handle leg along a line parallel to the longitudinal axis of said slot and passageway, and an actuating head being provided on the outer end of said actuating leg and said head having a larger cross-sectional area than said actuating leg.

3. The structure of claim 2 wherein said actuating leg includes an actuating head having a Y-shape and including a stem and outwardly flaring legs defining a notch therebetween for engaging the slider.

4. The structure of claim 2 wherein said legs are substantially equal length.

5. A tool for unlatching door security locks of the type having a chain extending from the door frame to a slider movable an access opening at the inner end of a slot in a plate secured to the door and forming a passageway between the plate and door open at the end adjacent the door edge, said tool comprising, U-shaped elongated member having an actuating leg and a handle leg interconnected by a base portion wherein the outer end of said actuating leg positioned on the inside of the door is adapted to engage said slider in said passageway or on the outside of said plate for moving the slider in said slot towards said access opening for removal therefrom as a person moves the handle leg along a line parallel to the longitudinal axis of said slot and passageway, and said leg portions including perpendicularly extending portions terminating in said base portion whereby the effective length of said legs is increased when used on a door having a slider movable inwardly and upwardly.

6. The method of unlatching a door security lock of the type having a chain extending from the door frame to a slider movable in an access opening at the inner end of the slot in a plate secured to the door and forming a passageway between the plate and door open at the end adjacent the door edge, comprising the steps of, positioning a U-shaped lock opening tool in a position embracing the door between the door edge and door frame with the legs of the tool being positioned on opposite sides of the door, positioning the actuating leg of the tool with the outer free end against the slider either in the passageway or on the outside of the plate, and moving the handle leg on the outside of the door away from the door edge along a line parallel to the longitudinal axis of the slot and passageway and thereby moving the slider to the access opening for removal therefrom for opening the door.

* * * * *